United States Patent [19]

Toyoda et al.

[11] 4,410,950

[45] Oct. 18, 1983

[54] METHOD OF AND APPARATUS FOR MONITORING PERFORMANCE OF STEAM POWER PLANT

[75] Inventors: Keiichi Toyoda, Katsuta; Tsugutomo Teranishi, Hitachi, both of Japan

[73] Assignee: Hitachi, Ltd., Tokyo, Japan

[21] Appl. No.: 217,046

[22] Filed: Dec. 16, 1980

[30] Foreign Application Priority Data

Dec. 17, 1979 [JP] Japan ..... 54-162788

[51] Int. Cl.[3] ..... G06F 15/20

[52] U.S. Cl. ..... 364/551; 364/492

[58] Field of Search ..... 364/492, 494, 551, 900, 364/200, 431.02

[56] References Cited

U.S. PATENT DOCUMENTS

| | | | |
|---|---|---|---|
| 3,636,335 | 1/1972 | Nelson et al. | 364/551 X |
| 4,074,357 | 2/1978 | Gupta et al. | 364/494 |
| 4,087,860 | 5/1978 | Beatty et al. | 364/494 |
| 4,091,450 | 5/1978 | Block et al. | 364/494 |
| 4,181,840 | 1/1980 | Osborne | 364/494 X |
| 4,215,412 | 7/1980 | Bernier et al. | 364/551 |

*Primary Examiner*—Edward J. Wise

*Attorney, Agent, or Firm*—Antonelli, Terry & Wands

[57] ABSTRACT

Apparatus and method of monitoring the performance of a steam power plant, wherein the monitoring is made through a calculation of the performance from detected data representing the states of operation of various parts of the plant, such as feedwater flow rate, steam pressure, steam temperature and the level of the load imposed on the plant. The method has a function for judging the fluctuation of the load and a function for judging the duration of steady state of the load. When the rate of fluctuation of the load is below a predetermined reference and this state of load lasts over a predetermined time length, it is judged that the data detected during this time length are valid as the data for monitoring of the performance and the performance is calculated from these data to permit the monitoring. The apparatus comprises a first comparator for comparing the rate of fluctuation of the load detected by the detector for detecting the load with a predetermined reference value, a second comparator for comparing the detection duration or time length of the detection obtained from the detector for detecting the load with a predetermined reference value, and judging means adapted to permit the detected data to be delivered to the plant performance calculation means for the calculation of the heat rate of the plant, in accordance with the outputs from the first and the second comparators, when the rate of fluctuation of the load is below the level of the reference value and this state of the load lasts over a predetermined time length.

12 Claims, 19 Drawing Figures

METHOD OF AND APPARATUS FOR MONITORING PERFORMANCE OF STEAM POWER PLANT

BACKGROUND OF THE INVENTION

The present invention relates to a method of and an apparatus for monitoring the performance of a steam power plant.

In the conventional system for monitoring the performance of a steam power plant, the monitoring is made through a calculation of the heat rate on the basis of data such as steam pressure, steam temperature, steam flow rate, turbine load and so forth.

This conventional system, however, involves a problem in that the calculation of heat rate the plant fluctuates largely to reach impractical values, particularly when the change of the level of load is large, because such a change of level of load of the power generating plant is not taken into consideration at all in the calculation of heat rate.

In addition, the performance data measured in a steady load state are inconveniently mixed with the performance data measured in the unsteady load state and cannot be discriminated from the latter. Therefore, the reliability of the whole data becomes impractically low to deteriorate the quality of the monitoring of performance.

SUMMARY OF THE INVENTION

It is, therefore, an object of the invention to provide a method of monitoring the performance of a steam power plant which permits a highly accurate calculation of performance to realize a highly reliable monitoring of the performance of the steam power plant.

It is another object of the invention to provide an apparatus for monitoring the performance of a steam power plant which permits a highly accurate calculation of performance to realize a highly reliable monitoring of the performance of the steam power plant.

It is still another object of the invention to provide a method of monitoring performance of a steam power plant which realizes a highly accurate calculation of performance of a steam power plant taking into account the credibility of data concerning the operation state of the plant, thereby to achieve a highly reliable monitoring of performance of a steam power plant.

It is a further object of the invention to provide an apparatus for monitoring the performance of a steam power plant which realizes a highly accurate calculation of performance of a steam power plant taking into account the credibility of the data concerning the operation state of the plant, thereby to achieve a highly reliable monitoring of performance of a steam power plant.

To these ends, according to an aspect of the invention, there is provided a method of monitoring the performance of a steam power plant comprising: detecting values representing states of operation of various parts of the steam power plant; and making a calculation of performance of the plant on the basis of the detected values to observe the performance of the plant, only when the degree of fluctuation of the load imposed on the plant, as one of the detected values, falls within a predetermined range and lasts for a predetermined time length.

According to another aspect of the invention, there is provided an apparatus for monitoring the performance of a steam power plant comprising: detectors for detecting values representing the states of operation of various parts of the plant; judging means for judging whether the degree of fluctuation of the load imposed on the plant, detected by a plant load detector as one of the detectors, falls within a predetermined range and whether the state within the predetermined range lasts for a predetermined time length; and performance calculation means for calculating the performance of the steam power plant only when the judging means judges that the degree of fluctuation falls within the predetermined range and the state within the predetermined range lasts for a predetermined time length.

DESCRIPTION OF THE PREFERRED EMBODIMENT

An apparatus for monitoring the performance of a steam power generating plant, constructed in accordance with an embodiment of the invention, will be described hereinunder with reference to the accompanying drawings.

Figure 1:
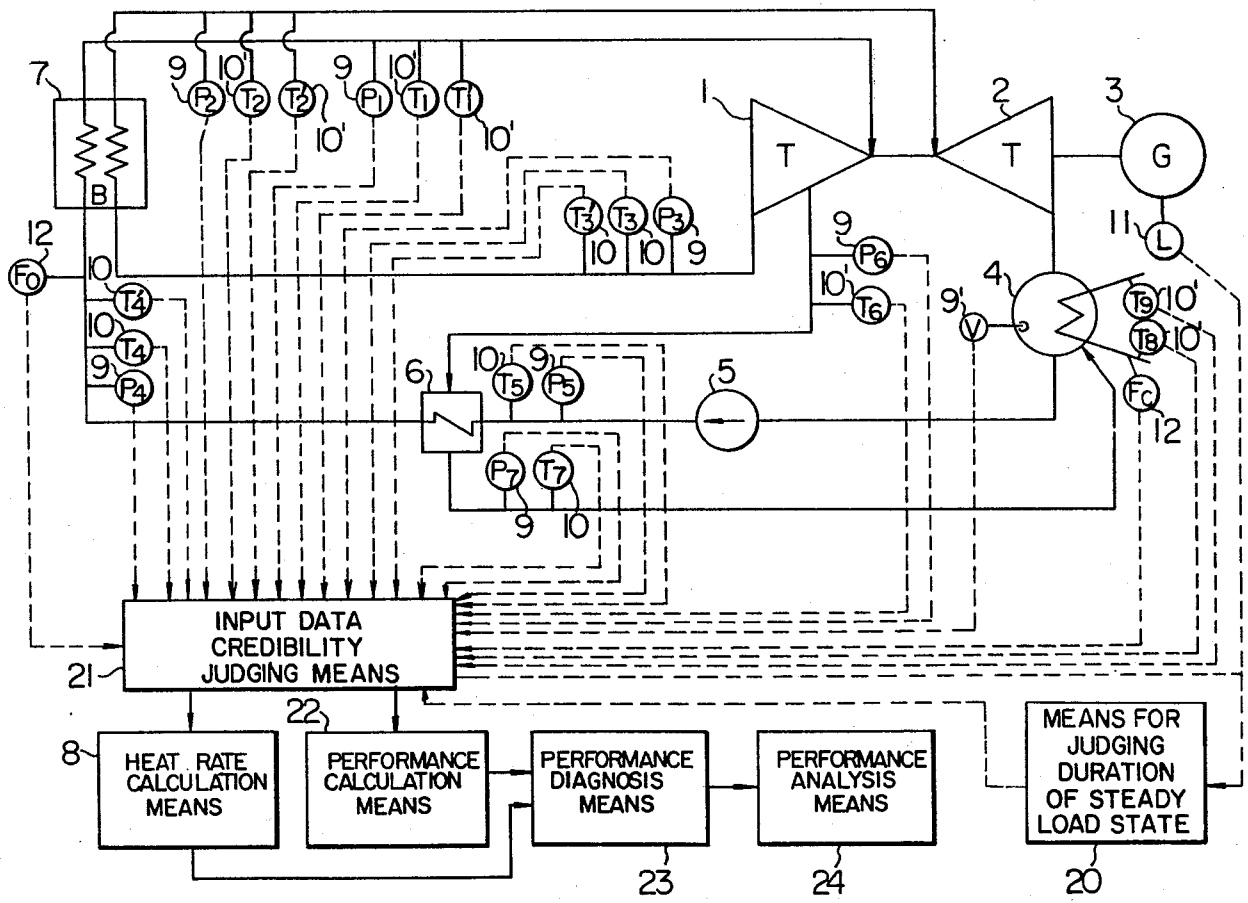
FIG. 1 is a schematic illustration of an apparatus for monitoring the performance of a steam turbine plant, constructed in accordance with an embodiment of the invention.

Referring first to FIG. 1 schematically showing a cycle construction of a steam power generating plant to which the present invention is applied, the steam generated in a boiler 7 flows into a high-pressure steam turbine 1 through a main steam pipe. The steam which has expanded and finished the work in the high-pressure turbine flows back to the boiler 7 through a low temperature reheating pipe. The steam is reheated in the boiler and then flows into a low-pressure turbine 3 through a high-temperature reheat pipe. The work performed by the steam in the high and low-pressure steam turbines is converted into electric energy by an alternator 3. The steam discharged from the low-pressure turbine 3 is condensed into water in a condenser 4, and is fed to the boiler 7. Generally, a feedwater heater 6 is disposed in the feedwater line. In the feedwater heater 6, the feedwater is heated by a bleed steam coming from the high-pressure turbine 1. The drain from the feedwater heater 6 is collected at the condenser 34. This is an example of the plant cycle to which the invention is applied.

Hereinafter, an explanation will be made as to the apparatus for monitoring the performance of this steam power generating plant.

There are provided a plurality of pressure detectors 9 for detecting main steam pressure $P_1$, high-temperature reheated steam pressure $P_2$, low-temperature reheated steam pressure $P_3$, feedwater heater outlet pressure $P_4$, feedwater heater inlet pressure $P_5$, bleed steam pressure $P_6$, and the feedwater heater drain pressure $P_7$. The detected pressure values are delivered to judging means 21. Also, there are provided a plurality of temperature detectors 10' adapted to detect main steam temperatures $T_1$, $T_1'$ at different points, high-temperature reheated steam temperatures $T_2$, $T_2'$, low-temperature reheated steam temperatures $T_3$, $T_3'$, bleed steam temperature $T_6$, feedwater heater inlet temperature $T_5$, feedwater outlet temperatures $T_4$, $T_4'$, feedwater heater drain temperature $T_7$, condenser sea water inlet temperature $T_8$, and the condenser sea water outlet temperature $T_9$. The detected temperature values are also delivered to the judging means 21.

The output L of the alternator is detected by the output detecting device 11. Also, a plurality of flow rate detectors 12 are provided for detecting the flow rate of feedwater (main feedwater flow rate Fo) to the boiler and flow rate Fc of sea water flowing into the condenser. Further, the vacuum V in the condenser is detected by a vacuum detector 9'.

These detected data are inputted to the judging means 21 for the judgment of credibility. The data concerning the alternator output L is delivered also to means 20 for judging the steadiness of load and duration of steady state. The aforesaid data are delivered to the judging means 21 only when the judging means 20 makes a decision that the load imposed on the plant is in the steady state. The data which are judged to be credible by the judging means 21 are delivered to a heat rate calculation means 8 for the calculation of heat rate, as well as to a performance calculation means 22. The data obtained through calculations are sent to steam power plant performance diagnosis means 23 and steam power plant performance analysis means 24 for the diagnosis and analysis of the performance.

The above-explained process will be explained hereinafter with specific reference to FIG. 2.

Figure 2:
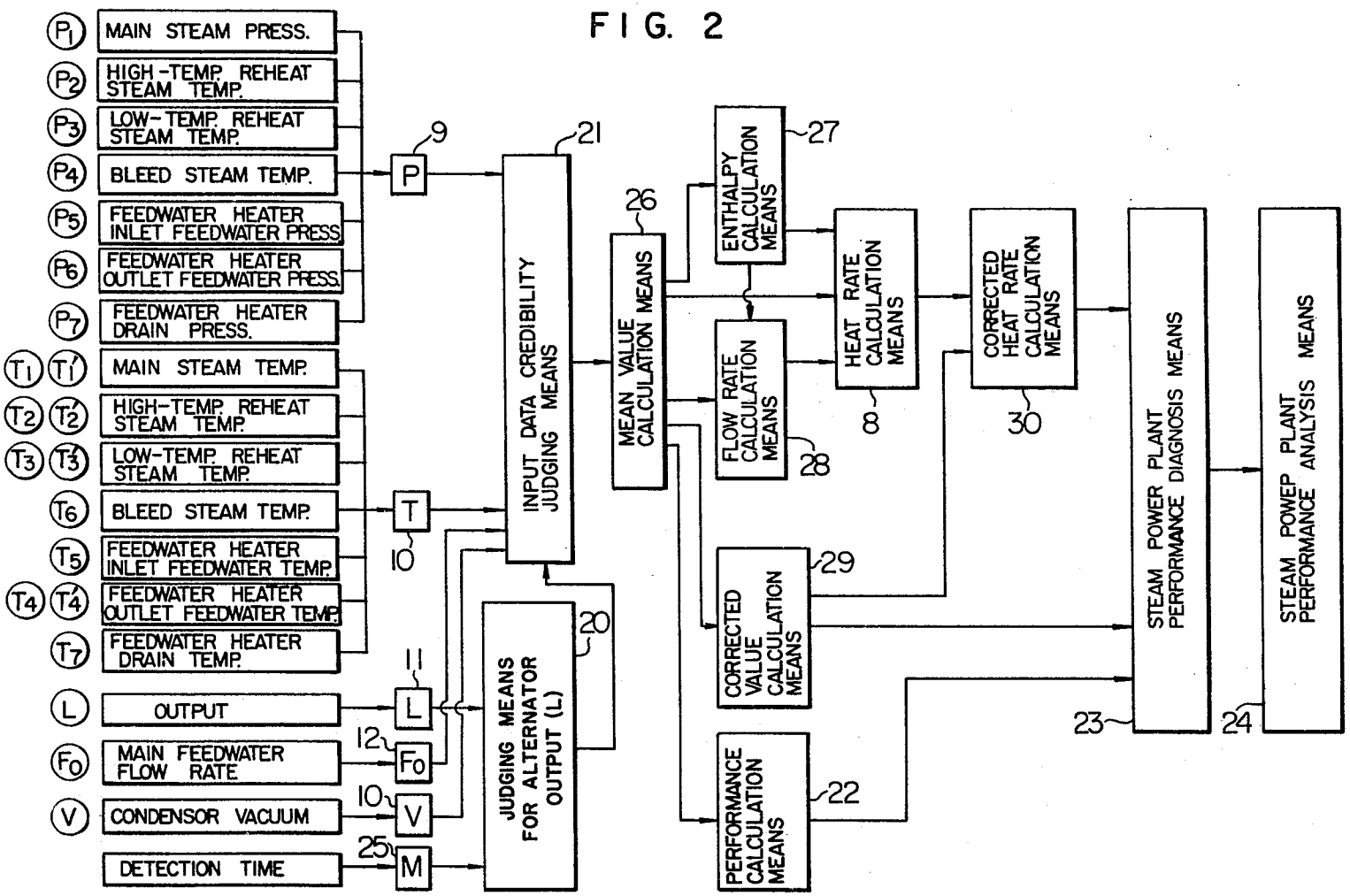
FIG. 2 is a block diagram showing the detail of the performance monitoring apparatus shown in FIG. 1.

Referring to FIG. 2, among the data showing the operation state values detected by the detectors 9 thru 12, the output L detected by the output detector 11 and the detection time M detected by the detection time detector 25 are delivered to the load steadiness and steadiness judging means 20. When the judging means 20 produces an OK signal, i.e. when it is judged that the load imposed on the plant is in the steady state, the data detected by the detectors are delivered to the judging means 21. The detected data judged to be credible in the judging means 21 are then sent to mean value calculation means 26 where the mean value is calculated for each of the detected data.

The load steadiness and steadiness duration judging means 20 and the input data credibility judging means 21 will be explained in detail, hereinunder.

Figure 3:
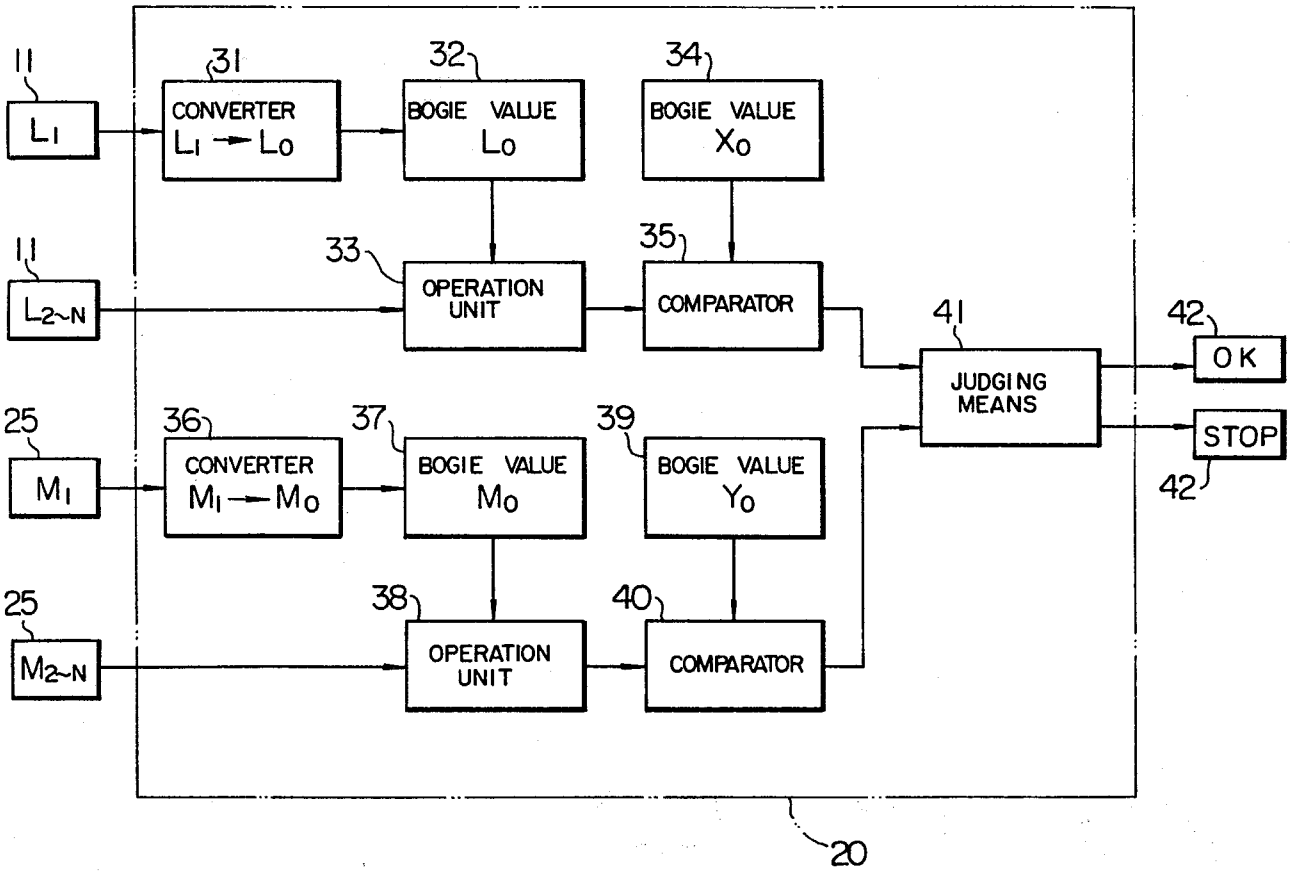
FIG. 3 is a block diagram showing the detail of means for judging the steadiness of the load and the duration of the steady state of the load.

Referring to FIG. 3 showing a block diagram of the load steadiness and steadiness duration judging means 20, the data $L_1$, $M_1$ detected in the first detection, concerning the load and the state of steadiness of the load, are converted into initial set values $L_o$, $M_o$ by converters 31, 36, and are set by setters 32, 37 as Bogie values $L_o$, $M_o$.

The data obtained second and subsequent detections $L_{2-N}$ and $M_{2-N}$ are delivered to operation units 33, 38. The operation unit 33 performs a calculation of deviation from the Bogie value $L_1$ to work out output data $X_{2-N}$ in accordance with the following equation.

$$\frac{L_{2-N} - L_o}{L_o} = X_{2-N}$$

Thus, the output data $X_{2-N}$ corresponds to the rate of fluctuation of the load per unit time. The load fluctuation rate $X_{2-N}$ is delivered to a comparator 35 and is compared with the Bogie value $X_o$ of load fluctuation rate stored in a setter 34. The result of the comparison is input to the judging means 41.

The detection time data $M_{2-N}$ is delivered to an operation unit 38 where the following calculation is performed using the Bogie value $M_o$, to obtain detection duration $Y_{2-N}$.

$$M_{2-N} - M_o = Y_{2-N}$$

The duration $Y_{2-N}$ is delivered to a comparator 40 and is compared with the Bogie value $Y_o$ stored in a setter 39. The result of the comparison is delivered to judging means 41.

The judging means 41 is adapted to judge whether the rate of fluctuation of the load (degree of load fluctuation) $X_{2-N}$ and whether the detection duration $Y_{2-N}$ is greater than the Bogie value $Y_o$.

Namely, it provides an OK signal when the load fluctuation rate $X_{2-N}$ is within the level of the Bogie value to permit each of the detected data to be delivered to the data credibility judging means 21 and allows the process to proceed to the calculation by an operation unit 26. The further process, i.e. the calculation of performance, is executed only when the detection duration $Y_{2-N}$ is above the level of the Bogie value $Y_o$. Namely, it is judged that the detected data can be effectively used in the calculation of performance at high credibility only when the steady state of the load imposed on the plant lasts for a predetermined time length.

The judging means 41 produces STOP signal when the above-mentioned conditions are not met. In such a case, the process cannot proceed so that all data are cleared and no calculation of performance is conducted.

Figure 4:
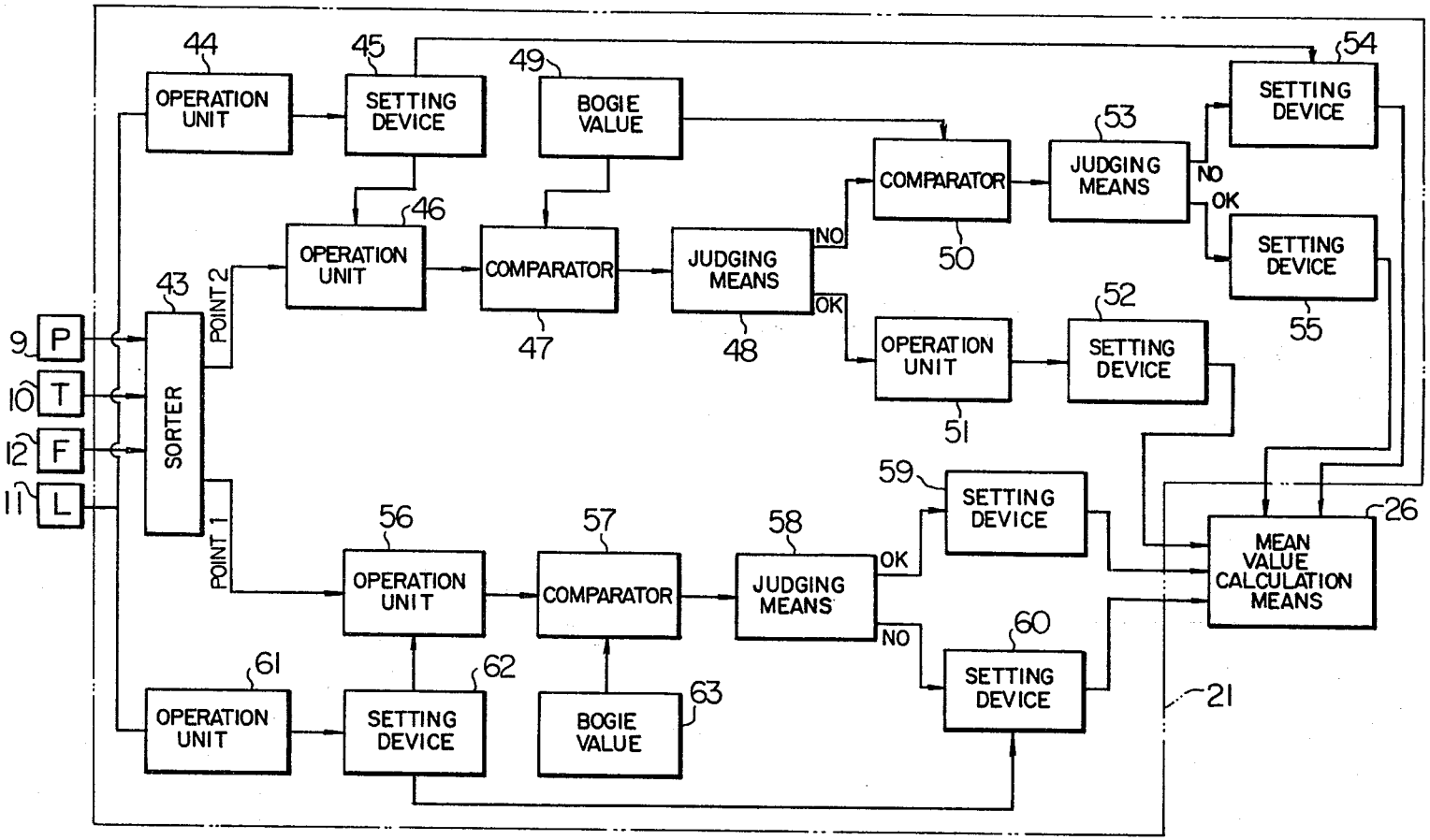
FIG. 4 is a block diagram showing the detail of an input data credibility judging device shown in FIG. 3.

FIG. 4 shows the detail of the input data credibility judging means 21 in block diagram.

The pressure data P, temperature data T and flow rate data F delivered to the input data credibility judging means 21 are sent to a sorter 43, while the output data L is forwarded to operation units 44, 61.

Figure 5:
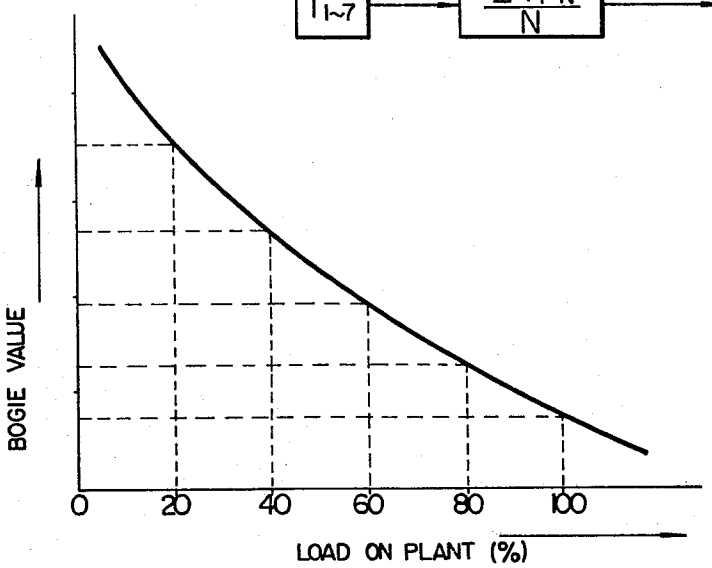
FIG. 5 shows a relationship between the load imposed on the plant and Bogie value.

Concerning the output data L, a Bogie value which is used as the reference in judgement of credibility is calculated by the operation units 44, 61. Namely, as shown in FIG. 5, the relationship between the Bogie value and the plant load is memorized beforehand for each detected data, and the output data is input. The Bogie value corresponding to the point at which the line representing the output data intersects the above-mentioned relationship is set in the setters 45, 62 as the reference Bogie value.

On the other hand, the sorter 43 makes a sorting of the detected data by the number of the input data.

In case that two input data of the same item are used, the deviations of these data from the reference Bogie value are performed by the operation unit 46, in accordance with the following equations.

$$\left|1 - \frac{A_1}{A_o}\right| = X_1 \left|1 - \frac{A_2}{A_o}\right| = X_2$$

where $A_1$ and $A_2$ represent the detected data and $A_o$ represents the Bogie value set in the setter 45.

The results $X_1$, $X_2$ of the calculation are delivered to the comparator 47 for a comparison with the deviation Bogie value $X_o$ stored in the storer 49 the result of which is sent to judging means 48.

In the judging means 48, judgment is made as to whether the deviations $X_1$ and $X_2$ are smaller than the Bogie value $X_o$ of the deviation. If this condition is met, these data are treated as being correct and credible and the process proceeds to the operation by operation unit 51, whereas, if the condition is not met, the process proceeds to a comparison by a comparator 50.

The operation unit 51 is for obtaining the mean values of the data $A_1$, $A_2$. The calculated mean values are delivered, as the representative values of the detected data $A_1$, $A_2$, to the mean value calculation means 26.

The comparator 50 performs, as is the case with the comparator 47, a comparison with the reference Bogie value, and delivers the result of the comparison to the judging means 53. When either one of the deviation $X_1$ and $X_2$ is smaller than the Bogie value $X_o$ of the deviation, the judging means makes a judgment that either one of $A_1$ and $A_2$ is correct and credible, and the process proceeds to the setter 55. If this condition is not met, the process proceeds to the setter 54.

The setter 55 sets one of the deviations $X_1$, $X_2$ smaller than the Bogie value $X_o$ as the representative value, and the process proceeds to the next step.

The proceeding of the process to the setter 54 means that both of the detected data $A_1$, $A_2$ are exceptional and are not usable for the calculation of performance. In this case, therefore, the reference Bogie value set in the setter 45 is set as the representative value and the process proceeds to the next step.

In the event that only one data is available for one item, the following calculation is made by the operation unit 56 with the detected data $B_1$ and the Bogie value $B_o$ set in the setter 62, to obtain a deviation $y_1$.

$$\left|1 - \frac{B_1}{B_o}\right| = y_1$$

The process then proceeds to a comparison by a comparator 57 which performs the comparison of the deviation with the Bogie value $Y_o$ of deviation stored in the storer 63.

The result of the comparison is input to judging means 58. When the deviation $y_1$ is smaller than the Bogie value $y_o$, the judging means 58 forwards the detected data $B_1$ as being correct and credible data to a setter 59. If this condition is not met, the detected data $B_1$ is delivered as being an exceptional data to a setter 60.

The setter 59 sets the detected data $B_1$ as data effective for the calculation of performance, and the process proceeds to the next step.

In contrast, the setter 60 sets the reference Bogie value $B_o$ as being effective data in place of the detected data $B_1$.

The data set in the above-mentioned setters 54, 55, 59 and 60 are delivered to the mean value calculating means 26 and is held in the latter until the load steadiness and steadiness duration judging means 20 produces the aforementioned OK signal. Namely, the performance calculation start instruction is issued when the judging means 20 has made the judgment that the steady load condition has been maintained over a predetermined time length. If the load level is changed within the above-mentioned predetermined time length, the data obtained in this period are treated as being invalid.

As the OK signal is issued from the judging means 20, the mean values of the data in the mean value calculation means 26 are forwarded to the next step of the process.

Referring to FIG. 5, an enthalpy calculating means 27 determines, on a graph (Mollier chart) in which the axis of ordinate and axis of abscissa represent enthalpy and entropy, the enthalpy data H from the mean value data of pressures $P_{1-7}$ and temperatures $T_{1-7}$. The enthalpy data $H_{1-7}$ are delivered to a flow rate operation unit 28 and the heat rate operation unit 8.

Figure 7:
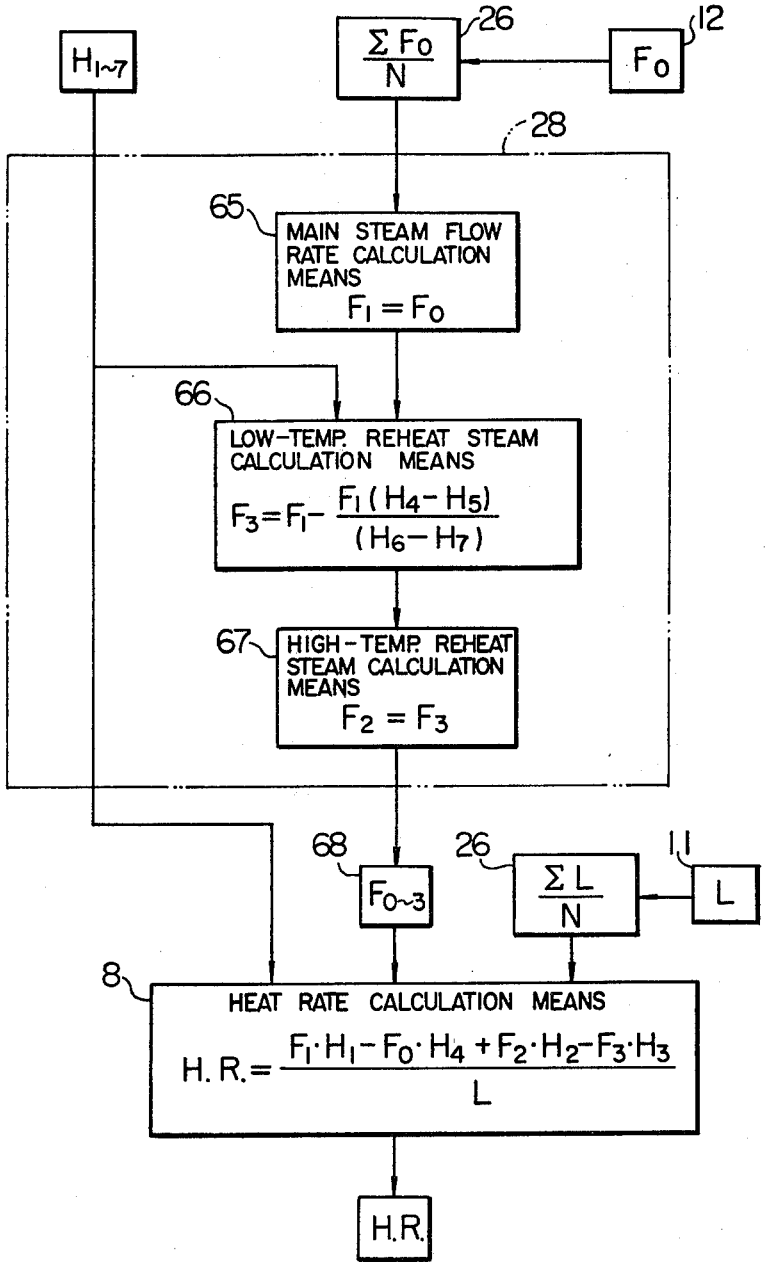
FIG. 7 is a block diagram showing the detail of flow rate calculating means and heat rate calculating means shown in FIG. 2.

As will be seen from FIG. 7, the flow rate calculation means 28 is constituted by flow rate calculation means 65, 66 and 67. Namely, in case where the plant cycle has the construction shown in FIG. 1, the main steam flow rate $F_1$ equals the feedwater flow rate $F_o$ so that the main steam flow rate calculation means 65 calculates the main steam flow rate $F_1$ from the condition of $F_1 = F_o$, and the process proceeds to the next step.

In the low-temperature reheat steam flow rate calculatoin means 66, the flow rate $F_3$ of the low-temperature reheat steam is calculated from the following relation which exists between the flow rate $F_1$ of main steam and flow rate $F_4$ of the bleed steam.

$$F_3 = F_1 - F_4 = F_1 - \frac{F_1(H_4 - H_5)}{H_6 - H_7}$$

In the high-temperature reheat steam flow rate calculation means 67, the flow rate $F_2$ of the high-temperature reheat steam is obtained from the condition of $F_2=F_3$, because both flow rates are equal to each other.

The flow rate data $F_{o-3}$, output data L and the enthalpy data 64 thus obtained are delivered to the heat rate calculatoin means 8 which calculates the heat rate H.R. in accordance with the following equation.

$$H.R. = \frac{F_1 \cdot H_1 - F_o \cdot H_4 + F_2 \cdot H_2 - F_3 \cdot H_3}{L}$$

The heat rate 69 thus obtained is delivered to corrected heat rate calculation means 30.

Figure 8:
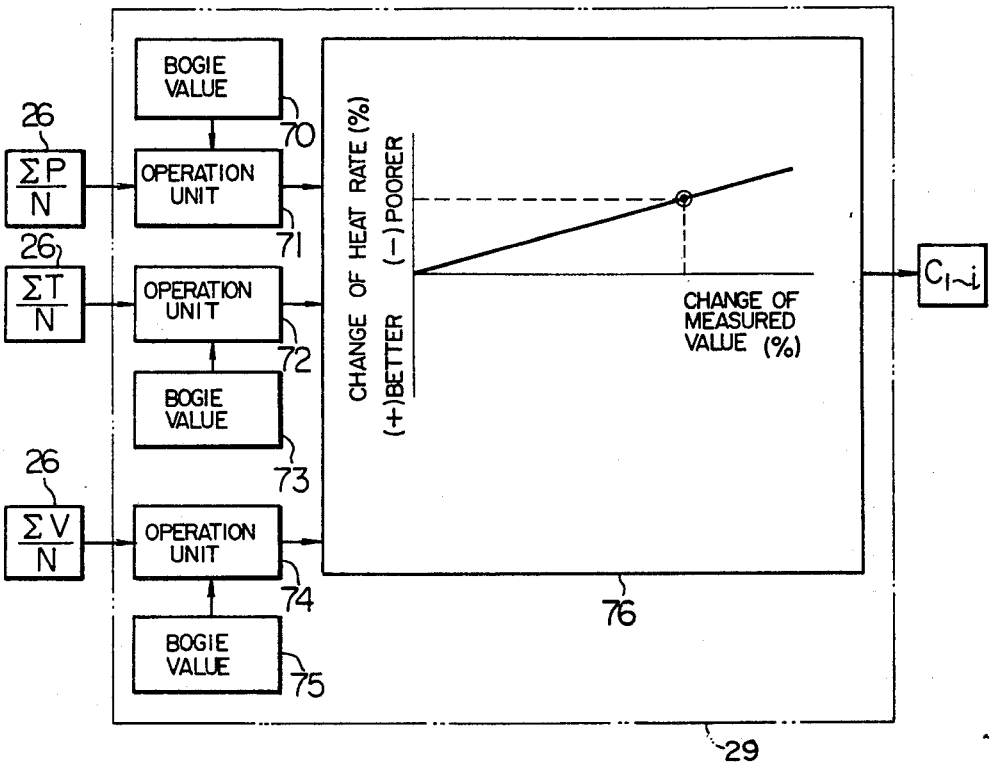
FIG. 8 is a block diagram showing the detail of correction value calculating means shown in FIG. 2.
Figure 9:
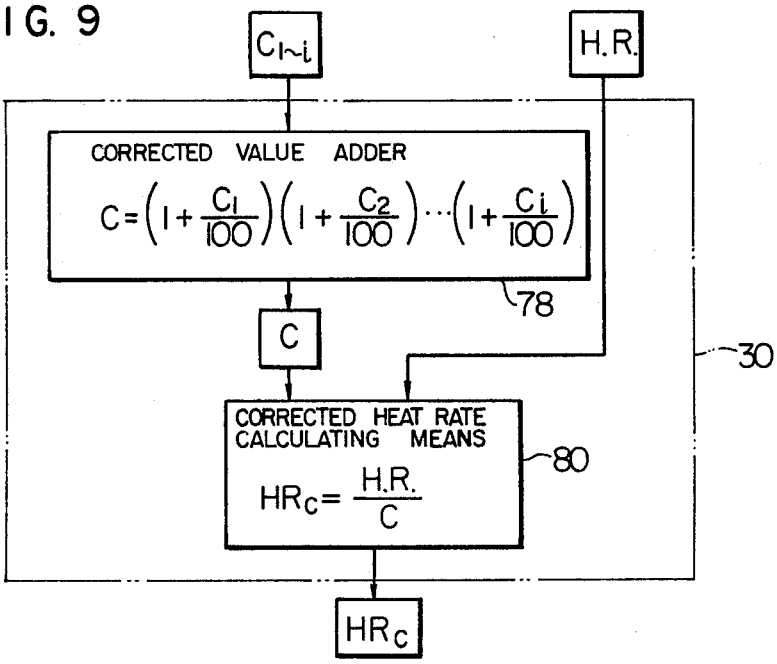
FIG. 9 is a block diagram showing the detail of corrected heat rate calculating means shown in FIG. 2.

Referring to FIG. 8, the mean values of the pressure P, temperature T, condenser Vacuum V are delivered to operation units 71, 72 and 74 of the calculation means 30, and the rates of changes from the design values stored in memories 70, 73 and 75 are calculated. The calculation of rate of change of pressure P is shown below by way of example.

$$\Delta P = \frac{P - P_o}{P_o} (\%)$$

where $\Delta P$ and $P_o$ represent the rate of change of measured pressure and design value, respectively.

The change of measured value thus obtained is then delivered to corrected value calculation means 76. In this calculation means 76, the calculated change of measured value is located on a correction curve drawn on a cordinate (axis of ordinate: change of heat rate, axis of abscissa: change of measured value) and the heat rate change, i.e. the correction value $C_{1-i}$ is obtained.

The correction value $C_{1-i}$ is delivered to the operation unit 78 in the calculation means 30, and the sum C of correction values is determined in accordance with the following equation.

$$C = \left(1 + \frac{C_1}{100}\right) \times \left(1 + \frac{C_2}{100}\right) \times \ldots \times \left(1 + \frac{C_i}{100}\right)$$

The sum C of correction value and the heat rate H.R. thus obtained are then delivered to the heat rate calculation means 80 which determines the corrected heat rate $HR_c$ in accordance with the following equation.

$$HR_c = \frac{HR}{C}$$

The corrected heat rate $HR_c$ is the heat rate which is obtained through correcting or normalizing, on the basis of the design value, the heat rate calculated from the actually measured values (detected data), so that the heat rate may be compared on the same basis, i.e. under the same operating condition.

The equipment performance calculation means 22 is for calculating the extent of influence of the performance of various equipment on the heat rate. The various equipment are the constituents of the plant, e.g. the turbine, boiler, feedwater heater, feedwater pump, condenser and so forth.

Figure 10:
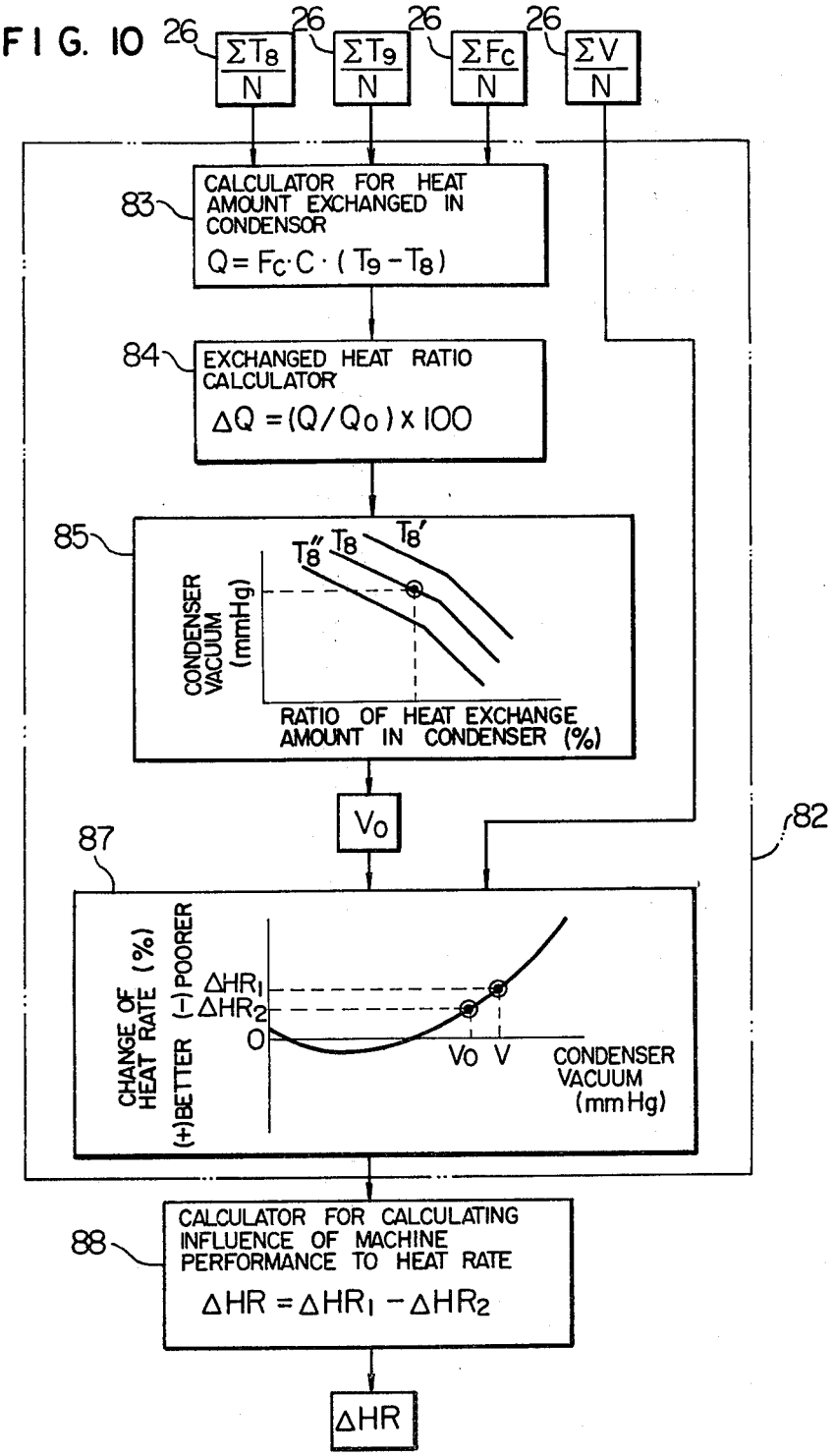
FIG. 10 is a block diagram showing the detail of performance calculating means shown in FIG. 2.

FIG. 10 shows, as an example of the equipment performance calculation means, means 82 for calculating the performance of the condenser 82. Referring to FIG. 10, the condenser outlet and inlet sea water temperatures $T_9$, $T_3$ and the mean value of the condenser sea water flow rate $F_c$ are delivered to exchanged heat amount calculation means 83 in which the amount Q of the heat exchanged in the condenser is calculated in accordance with the following equation.

$$Q = F_c \times C \times (T_9 - T_8)$$

C: specific heat of sea water

This value is then delivered to means 84 for calculating the ratio of exchanged heat amount. The calculation means 84 is adapted to calculate the ratio $\Delta Q$ of the amount of heat exchanged.

$$\Delta Q = \frac{Q}{Q_o} \times 100 (\%)$$

$Q_o$: design value of exchanged heat amount

The ratio $\Delta Q$ of exchanged heat amount is then delivered condenser vacuum estimating means 85 in which the calculated ratio $\Delta Q$ of exchanged heat amount is located on a curve (condenser performance curve) drawn on a graph in which the axis of ordinate and axis of abscissa represent, respectively, condenser vacuum and the ratio of heat amount exchanged in condenser, so that an estimated condenser vacuum 86 is obtained.

The estimated condenser vacuum $V_o$ and the mean value $\Sigma V/N$ of the actually measured vacuum are delivered to the equipment performance correction value calculation means 87 in which the changes $HR_1$ and $HR_2$ of heat rate are determined by a correction curve drawn on a coordinate in which the axis of ordinate and axis of abscissa represent, respectively, the change of the heat rate and the condenser vacuum.

These values are delivered to means 88 for calculating the extent of influence of the equipment performance, in which a calculation is made in accordance with the following equation to determine the influence $\Delta HR$ of the equipment performance on the heat rate.

$$\Delta HR = HR_1 - HR_2$$

The estimated vacuum $V_o$ varies in accordance with the change of state of the plant operation. In addition, the actually measured condenser vacuum involves the change of the performance of the condenser itself. The above equation, therefore, determines the influence of change of performance of the condenser itself on the heat rate.

It will be clear to those skilled in the art that the influence of performance of equipment such as turbines, boilers, feedwater heater, feedwater pumps and so forth can be considered in the same manner, by substituting factors peculiar to the equipments for the vacuum level of the condenser. More specifically, internal efficiency is substituted for the condenser vacuum, for the evaluation of influence of performance of the turbine. Similarly, pressure drop in the boiler, terminal temperature difference and drain cooler temperature difference, and shaft power loss are taken into consideration, in the case that the influence of performance of the boiler, feedwater heater and the feedwater pump are evaluated.

Figure 11:
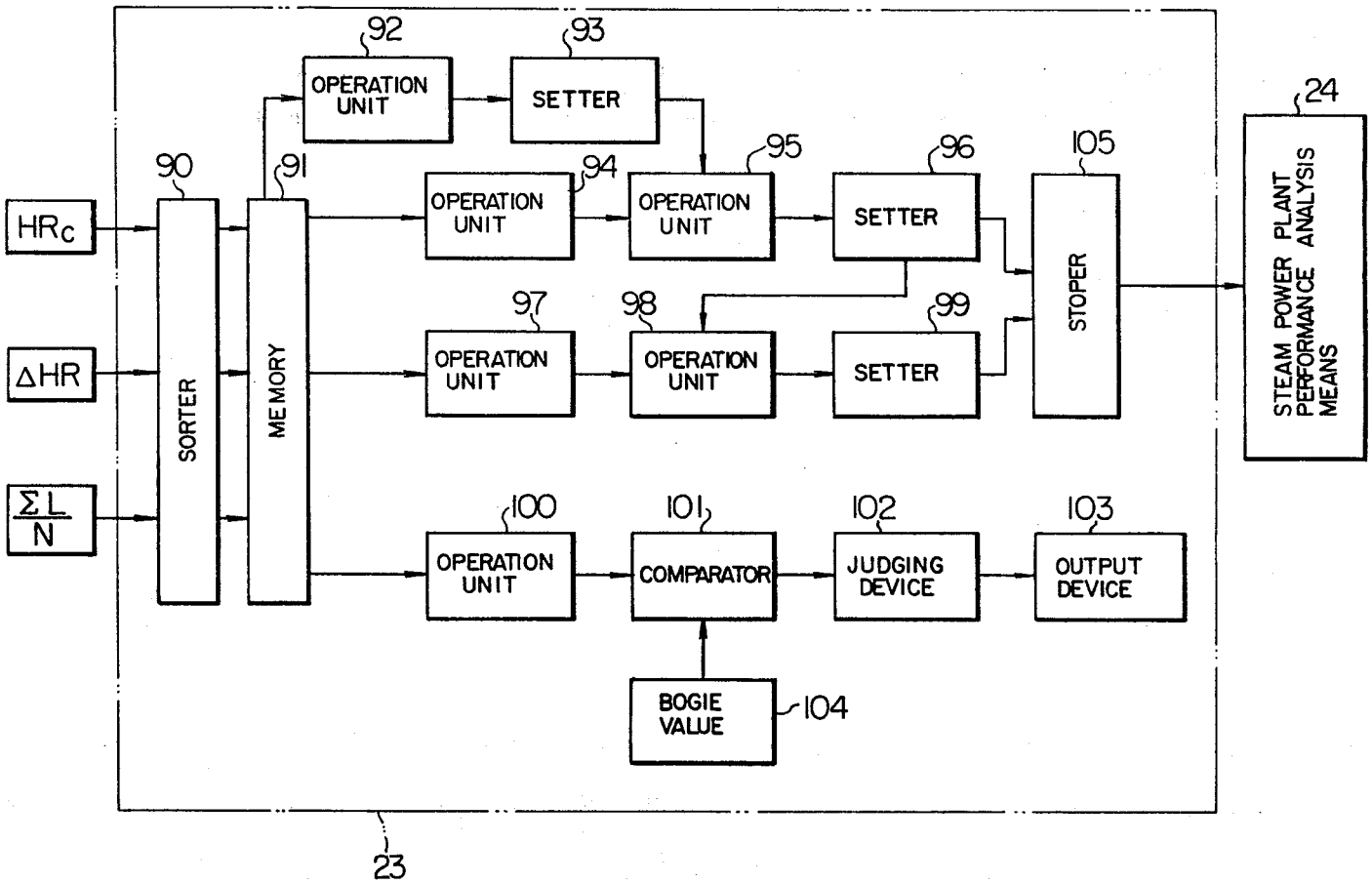
FIG. 11 is a block diagram showing the detail of diagnosis means for making diagnosis of performance of a steam power plant shown in FIG. 2.

Hereinafter, a description will be made as to the diagnosis means 23 for making the diagnosis of performance of the steam power plant. Referring to FIG. 11 showing detailed control block diagram of the diagnosis means 23, the input data HRc, $\Delta HR$ and $\Sigma L/N$ are first received by a sorter 90 and sorted in terms of load regions, e.g. load region over 80% load, load region between 80 and 60% load, load region between 60 and 40% load and load region below 40% load, and are memorized in a memory 91. After elapse of a predetermined time or when an operator's request is given, the process proceeds to the next step.

Figure 12:
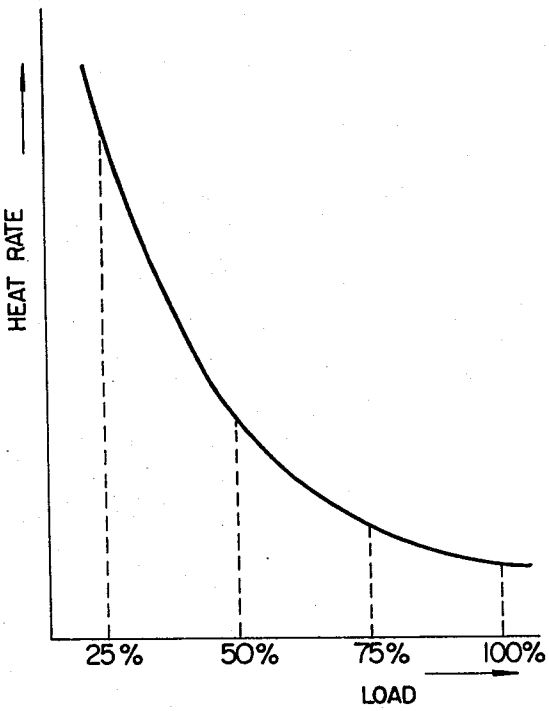
FIG. 12 is a chart showing the relationship between the load imposed on the plant and the heat rate reference Bogie value.

The corrected heat rate HRc is forwarded to an operation unit 94 which performs calculation of mean value HRc' of corrected heat rate for each load region. Simultaneously, an operation unit 92 performs the calculation of mean value of plant load in each load region. Then, using the diagram on coordinates shown in FIG. 12 in which the axis of the ordinate and the axis of the abscissa represent the heat rate and the plant load, respectively, reference Bogie value HRo of heat rate is determined and set by a setter 93.

An operation unit 95 performs the calculation of deviation of the corrected heat rate mean value HRc' from the reference Bogie value HRo in accordance with the following equation.

$$HRc\ (\%) = 1 - \frac{HRc'}{HRo}$$

The heat rate deviation HRc (%) is set in the setter for each plant load region.

On the other hand, as in the case of the corrected heat rate HRc, the degree of influence of machine performance ΔHR is sent to an operation unit 97 via the sorter 90 and the memory 91. Then, the mean value of the degree of influence is calculated for each load region and each equipment. The process then proceeds to an operation unit 98 which calculates, upon receipt of the heat rate deviation HRc (%) from the setter 96, the degree of influence of equipment performance on the degradation of heat rate, i.e. how the performance of the plant is deteriorated by each equipment, in accordance with the following equation.

$$\Delta HR\ (\%) = \frac{\Delta HR'}{HRc\ (\%)} \times 100$$

where ΔHR' represents the mean value of degree of influence of equipment performance.

In addition to the above-described functions, the diagnosis means 23 has a function of detecting any failure or abnormality in the performance of equipment, as will be understood from the following description.

An operation unit 100 performs a calculation of mean value of degree ΔHR of influence of the equipment performance for each load region and each equipment. The mean value thus calculated is delivered to a comparator 101 which compares the thus calculated mean value with the reference Bogie value memorized in the memory 104.

When it is determined in judging device 102 receiving the signal from comparator 101 that the reference Bogie value is exceeded, i.e. that the deterioration of performance of equipment is serious, an output device 103 produces a suitable output such as an alarm to inform the operator that a check or the like of the equipment is necessary. The diagnosis means 23 thus functions also as detector for detecting any abnormality in the performance of the equipment.

The heat rate deviation HRc (%) and the deviation ΔHR (%) of degree of influence of equipment performance, which are set in the setters 96, 99, are stored in the memory 105 for each period.

Hereinafter, an explanation will be made as to the analysis means 24 for making an analysis of the performance of the steam power plant.

Figure 13:
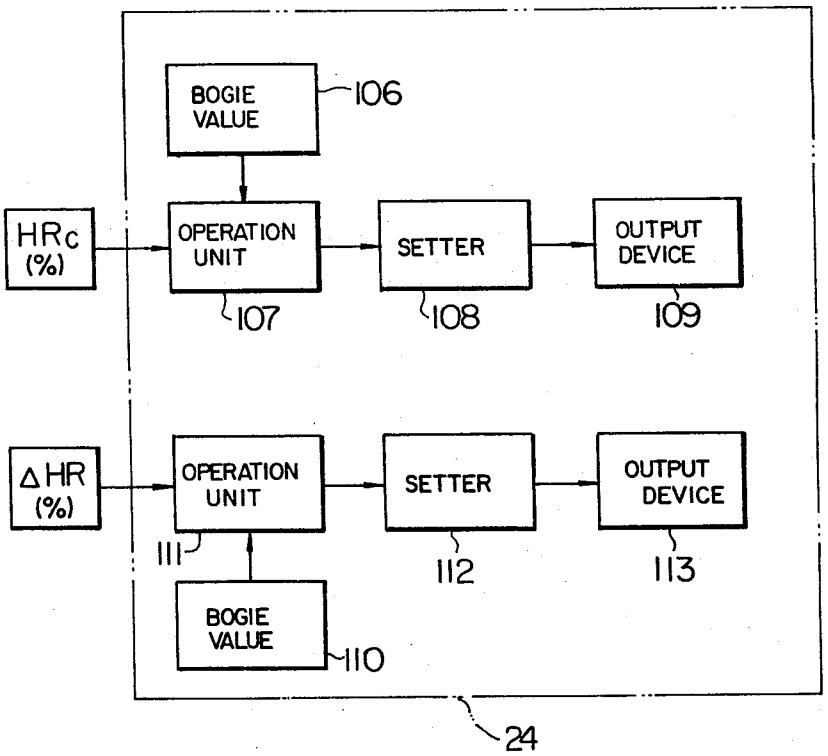
FIG. 13 is a block diagram showing the detail of performance analysis means for analyzing the performance of the steam power plant.

FIG. 13 is a detailed control block diagram of the analysis means 24. After elapse of a predetermined time or by an operator request, the corrected heat rate deviation HRc (%) and the deviation ΔHR (%) of degree of influence of equipment performance are delivered to operation units 107 and 111 in the analysis means 24. In these operation units, calculations are made to determine the differences of these data from the data obtained at the initial period of operation of the plant or immediately after a periodical inspection which are stored in Bogie value memories 106 and 110. The data stored in these memories are represented by HRC (%) BASE and ΔHR (%) BASE, respectively.

Thus, rate of secular change (past data) of heat rate ΔHRc (%) and rate of secular change of each equipment ΔHR' (%) are given by the following equations.

$$\Delta HRc\ (\%) = HRc\ (\%) - HRc\ (\%)\ BASE$$

$$\Delta HR'\ (\%) = \Delta HR\ (\%) - \Delta HR\ (\%)\ BASE$$

These differences, i.e. the rates of change ΔHRc (%) and ΔHR' (%) are set by setters 108 and 112, and are printed out or displayed by means of output devices 109 and 113.

Hereinafter, the content of monitoring of performance of a steam power generating plant, in accordance with the invention, will be explained with reference to FIG. 14 which shows a schematic flow chart of the monitoring technique in accordance with the invention.

Figure 14:
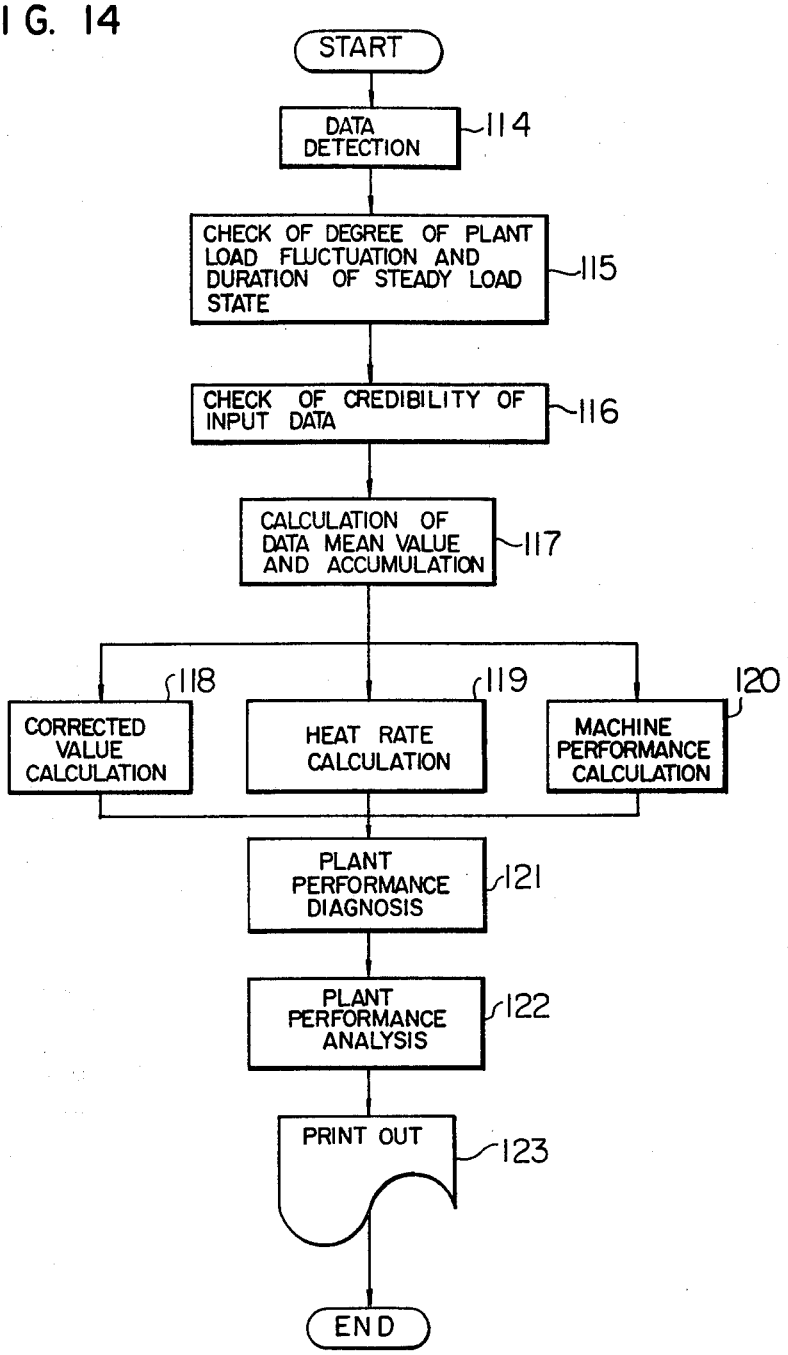
FIG. 14 is a flow chart schematically showing the method of monitoring the performance by the performance monitoring apparatus shown in FIG. 2.
Figure 15:
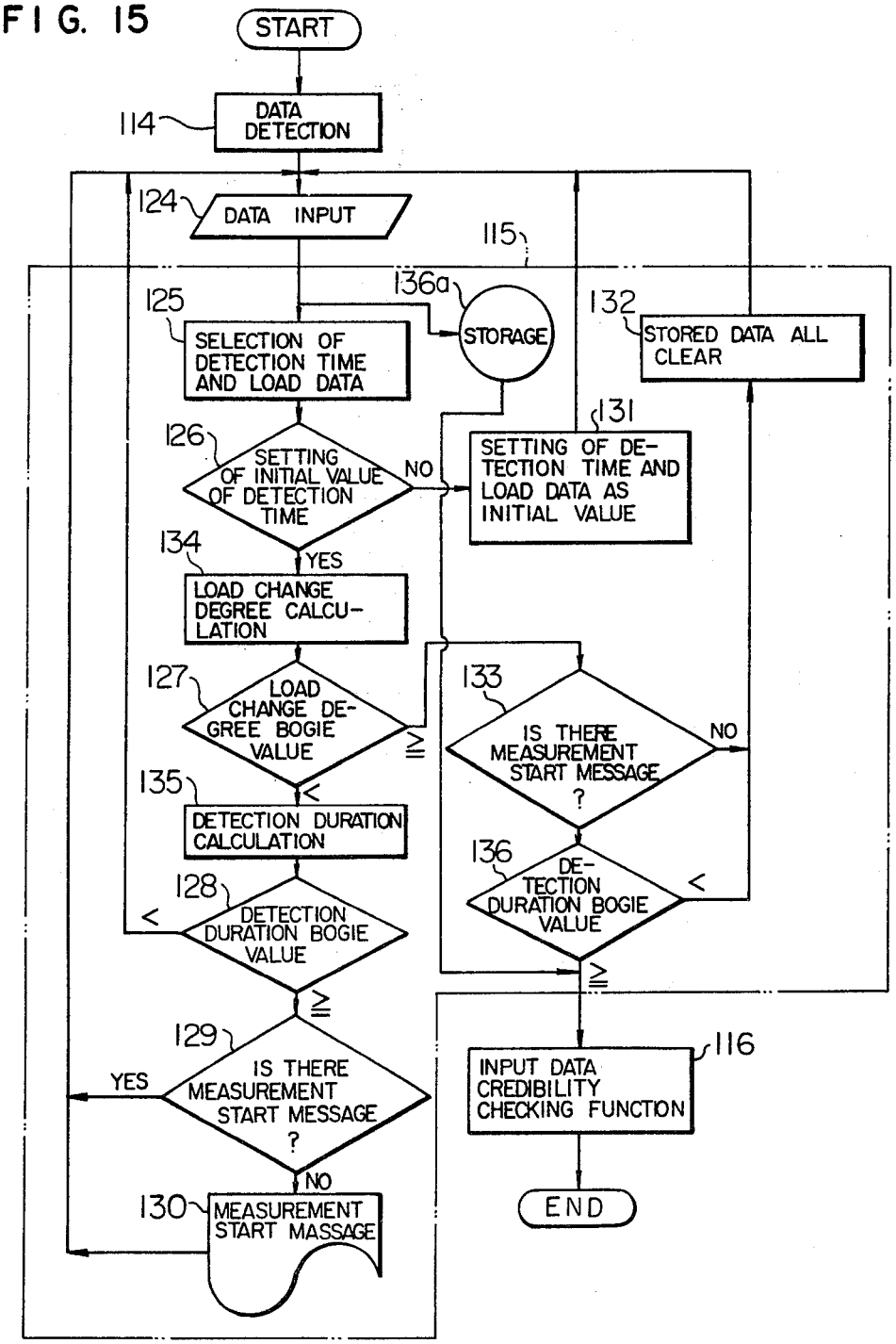
FIG. 15 is a flow chart of the process shown in FIG. 14 for checking the degree of fluctuation of the load and duration of steady load state.

FIG. 15 shows the flow chart of the function 115 shown in the flow chart of FIG. 14, for checking the steadiness of the load and duration of steady state of the load.

Referring to these Figures, the detected date representing the states of operation of the plant are delivered to the checking function 115 through a data inputting step 124. Then, in the step 125 for selecting the detection time and the load data, data concerning the detection time and data concerning the load (output) are selected from the detected data. Then, the process proceeds to the step 126 for checking the initial set of detection time. This step 126 corresponds to converters 31, 36 or FIG. 3.

In the step 126, it is cheked whether the initial value $M_o$ of detection time is set or not. For the first detection, therefore, it is necessary to set the initial values. Therefore, the data (Time $M_1$, Load $L_1$) detected in the first detection are set as initial values $M_o$, $L_o$ in the step 131 for setting initial values, and are returned to the step 124. This step 131 correspond to the setters 32, 37 of FIG. 3.

The data obtained in the second and further detections, the process proceeds to the step 134 for calculating the rate of fluctuation of load. This step 134 corresponds to the operation unit 33 of FIG. 3. The data $X_{2-N}$ which are the result of calculation in this step are delivered to the next step 127 for checking the rate of load fluctuation. This step 127 corresponds to the comparator 35 and the judging means 41 in FIG. 3. In this step 127, it is checked whether the load imposed on the plant is in the steady state or not. More specifically, the deviations $X_{2-N}$ are compared with the Bogie value $X_o$ in relation to the initial value $L_o$ of load data set in the step 131 to judge that only the data obtained while the load is in steady state can be used effectively for the calculation of performance. Namely, when the deviations $X_{2-N}$ are smaller than the Bogie value $X_o$, the process proceeds to the step 135 for calculating the duration or time length of continuation of detection. This step 135 corresponds to the operation unit 38 of FIG. 3. However, if this condition is not met, the process proceeds to the step 133 for checking the measurement start message output.

In the aforementioned step 127, the step 135, which is taken when the deviation is smaller than the Bogie value, is the step for calculating the time length of continuation or duration of detection. Thereafter, the process proceeds to the next step 128 for checking the start of measurement. This step 128 corresponds to the comparator 40 and judging means 41 of FIG. 3, and is provided for checking whether the predetermined time length has passed under the steady load state of the plant, i.e. the step for effecting the comparison between the duration or time length $Y_{2-N}$ of steady state of the load and the Bogie value $Y_o$. The detail of this step will be explained later with reference to FIG. 17.

In the step 128, if the duration $Y_{2-N}$ is smaller than the Bogie value $Y_o$, the process returns again to the data input step 124 and the steps heretofore described are taken sequentially.

When the duration $Y_{2-N}$ is greater than the Bogie value $Y_o$, it is judged that the load is steady enough so that the detected data can be used effectively as the data for calculating the performance, so that the process proceeds to the step 129 for checking the measurement start message output.

As stated above, the data obtained before the Bogie value is reached are judged to be invalid in the step 128, even if the load state is judged to be sufficiently steady in the step 127. This is because, according to the invention, only the data obtained in the completely steady load state, i.e. after elapse of a predetermined setting time are valid for calculation of performance of the power plant.

Thus, the steps 128 or the step 127 greatly contributes to the improvement of accuracy of the performance calculation and, hence, the reliability of the result of calculation.

The aforementioned step 129 is a step for informing the operator of the commencement of detection of data which are valid for the performance calculation. In this step, it is checked whether this message is issued or not and, when this message is not issued, the message is produced at the step 130 for outputting the measurement start message. To the contrary, if the message has been issued, the process is returned to the data input step 124 and data are input again to take the foregoing steps.

On the other hand, if it is judged in the load fluctuation checking step 127 that the deviation $X_{2-N}$ is greater than the Bogie value $X_o$, the process proceeds to the step 133 of checking the measurement start message output.

There are three cases of different paths of progress from the step 127 to the step 133: namely (i) a case in which the detected data are input while the plant load is not steady, (ii) a case in which, although the plant load is steady, the duration of steady state is so short that the load is changed again before the issue of the measurement start message and (iii) a case in which the plant load is steady and the setting time is longer than the Bogie value to permit the measurement start message to be issued.

In the cases (i) and (ii), the process proceeds to the step 133 of checking of the measurement start message. In these cases, however, it is judged that no data valid for the performance calculation is stored in the memory, because the measurement start message is not issued in these cases. In these cases, therefore, the data are all cleared in the data clearing step 132 and the process returns again to the data input step 124 to collect new data necessary for the calculation of performance.

In the third case, i.e., in the case where the measurement start message is available, the process proceeds to the step 136 for checking the duration or time length of continuation of detection. This step 136 corresponds to the judging means 41 of FIG. 3.

In the step 136, the duration of detection, i.e. the time length between the start of detection of valid data after finish of setting time and the moment at which the load starts to fluctuate again, is compared with the Bogie value, thereby to check whether predetermined number of data necessary for the performance calculation are stored in the memory.

In the event that the detection duration $Y_{2-N}$ is shorter than the Bogie value $Y_o$, the stored data are cleared in the data clearing step 132, and the process is returned to the data input step 124.

Figure 16:
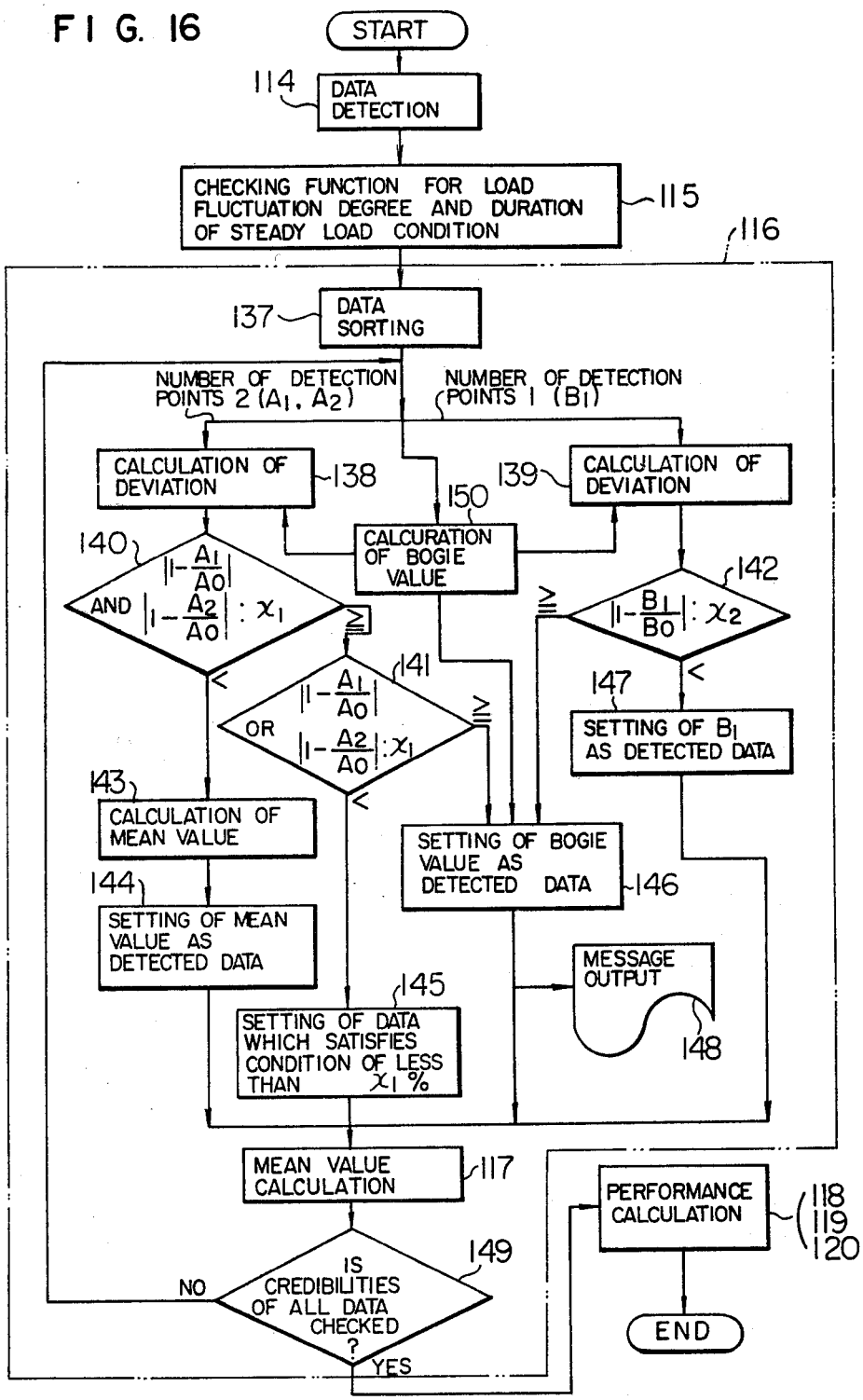
FIG. 16 is a detailed flow chart of a process for checking the credibility of input data as shown in FIG. 14.

To the contrary, if the detection duration $Y_{2-N}$ is longer than the Bogie value $Y_o$, the process proceeds to the performance calculation steps 118 thru 120 shown in FIG. 16. The step 119 of these steps 118 thru 120 corresponds to the heat rate calculation means 8 of FIG. 2. Namely, in this step 119, the calculation of performance is made on the basis of the data in the memory area.

The result of the calculation is displayed and printed out.

After the printing out of the calculation result, the process is returned again to the data input step 124 to take the successive steps described heretofore.

Figure 17:
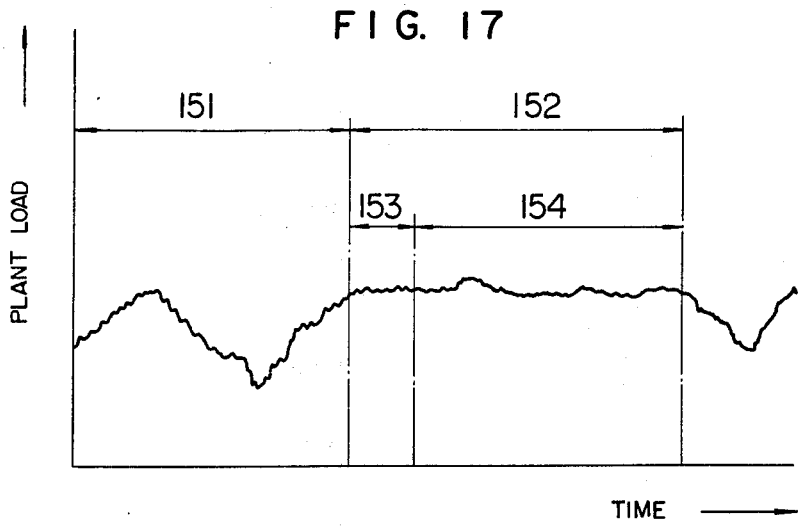
FIG. 17 is an illustration of degree of load fluctuation and duration of steady load state.

FIG. 17 shows the state of fluctuation of load imposed on the plant. In this Figure, a reference numeral 152 designates a region in which both of the load fluctuation rate and the duration of steady state of load are acceptable. This region can be divided into a first period 153 which is the plant load setting period and another period 154 which is a calculation data detecting period. The plant load setting period 153 is the period between the moment at which the load is stabilized and a moment at which the plant is completely stabilized, i.e. the period before the plant is set steady.

The calculation data detecting period 154 is the period after the setting 153 of the plant load till the plant load is changed again.

Namely, the aim of the check in the step 128 through comparison of the detection duration $Y_{2-N}$ and the Bogie value $Y_o$ is to preserve the above-explained plant load setting period 153.

Also, the comparison between the detection duration $Y_{2-N}$ and the Bogie value $Y_o$ performed in the detection duration checking step 136 is made for the purpose of preservation of the above-explained calculation data detecting period 154 and confirmation of availability of the data valid for the performance calculation in the period 154.

If the detection duration is shorter than the Bogie value, all of the data are cleared from the memory area in the step 132, so that the process is returned to the step 124 for inputting of new data.

Thanks to the preservation of the plant load setting period 153 and the calculation data detection period 154 shown in FIG. 17, it is possible to supply the user with highly reliable calculation result, provided that the load applied to the plant is in the steady state, irrespective of level of the load. It is possible to sense, in the aforementioned step 128, the steady state of the load through judging whether the rate of fluctuation of factors such as pressure, temperature or flow rate has fallen below a predetermined level, instead of preserving the setting time. Namely, if the rate of fluctuation of factor representing the operation state of the plant, e.g. pressure, temperature and flow rate falls within a region which is beforehand obtained through performance test or the like, it is considered that the plant is in the steady condition completely.

In the system of the invention, the data obtained under the steady condition of the plant are regarded as being valid. Therefore, the preservation of the setting time is an important factor in carrying out the invention, and this method is quite effective from the view point of preservation of the setting time, as well as for the improvement in the reliabilities of the data used in the calculation and, hence, the calculation result.

Referring again to FIG. 15, if the detection duration detected in the detection duration checking step 136 is longer than the Bogie value, the process proceeds to the input data credibility checking function 116.

This function will be described in detail with specific reference to FIG. 16.

Figure 6:
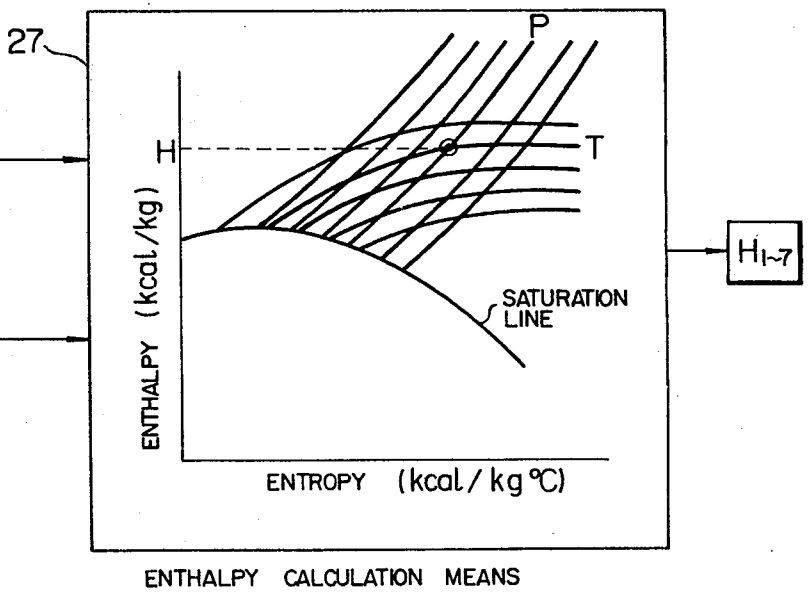
FIG. 6 is a block diagram showing the detail of enthalpy calculating means shown in FIG. 2.

In accordance with the signal from the function 115, all data in the memory step 136 are delivered to the data storing step 137 in the function 116. This step 137 is for sorting the data in accordance with the number of inputs, and corresponds to the sorter 43 shown in FIG. 6.

For the most important data among the data to be detected, there are provided a plurality of measuring points for one measuring item. The step 137 is therefore provided for sorting the data in accordance with the number of inputs. The data having two inputs are forwarded to the step 138, while the data having only one input is sent to the step 139.

Deviation calculation steps 138, 139, which correspond to the operation units 46, 56 of FIG. 4, are provided for calculating the deviations of detected data from the reference Bogie value calculated in the Bogie value calculating step 150 corresponding to the operation units 44, 61 and setters 45, 62 shown in FIG. 4. The calculated deviations are input to the steps 140 and 142.

In the detected data credibility checking step 140, two input data are forwarded as being credible data to the mean value calculation step 143, provided that both data falls below the Bogie value. The step 140 corresponds to the comparator 47 and judging device 48 in FIG. 4, while the step 143 corresponds to the operation unit 51 in FIG. 4. The calculated mean value is set by the detected data setting step 144 as the detected data. This step 144 corresponds to the setter 52 in FIG. 4. In all other cases, the process proceeds to the detected data credibility checking step 141 which corresponds to the comparator 50 and judging device 53 and FIG. 4. If either one of the two deviations meets the Bogie value, this data is set as the detected data in the detected data setting step 145 which corresponds to the setter 55 in FIG. 4.

If this condition is not met, the process proceeds to the step 146.

Meanwhile, the detected data having only one input is delivered to the detected data credibility checking step 142 as in the case of the detected data having two inputs. This step 142 corresponds to the comparator 57 and the judging device 58 in FIG. 4. In this step, the detected data are compared with reference Bogie values and, if the detected data are within the level of the reference Bogie value, the data are set by setting step 147 which corresponds to the setter 59 shown in FIG. 4. However, if the data exceed the level of the reference Bogie value, the process proceeds to the Bogie value setting step 146 which corresponds to the setters 54, 60 of FIG. 4.

The proceeding of the process to the step 146 means, irrespective of the number of detection points, that the data are exceptional and abnormal. The use of such data in the performance calculation will degrade the reliability of the calculation results such as heat rate.

In such a case, therefore, the reference Bogie value is set in place of such data. At the same time, the abnormality of the detected data is informed to the operator in the message output step 148.

As has been described, the data set in one of the setting steps 144, 145, 146 and 147 is delivered to the data mean and integration function 117 for the calculation of mean value and integrated value.

This process applies to all of the data stored in the memory and, then, the process proceeds to the performance calculation functions 118, 119, 120.

The results of the performance calculation are delivered to the data sorting step 156 in the plant performance diagnosis function 121. The step 156 corresponds to the sorter 90 in FIG. 11.

The step 156 is provided for sorting the data in terms of load level, and the data sorted in accordance with the load level are stored in the order of the load level in the data memory step 157 which corresponds to the memory 91 in FIG. 11.

The data are stored until the diagnosis start time checking step 158 judges that the predetermined time length has elapsed or that an operator request is issued.

Upon receipt of the signal from the step 158, in the data selection step 159, the data of one of the load regions are delivered to the next step. This procedure is sorted into following three cases or paths.

The first path includes the step 160 for calculating the mean value of the corrected heat rate. This step corresponds to the operation unit 94 in FIG. 11. The mean value of corrected heat rate is made for each load region. The calculated mean value is delivered to the heat rate deviation calculating step 162 which corresponds to the operation unit 95 in FIG. 11, where the deviation from heat rate reference Bogie value is calculated for each load region.

In the second path, there is provided a step 161 for calculating the mean value of degree of influence of equipment performance, which corresponds to the operation unit 97 in FIG. 11. In this step, the mean value of the degrees of each influence of equipment are calculated for each load region. The calculated mean values are delivered to the step 163 for calculating the deviation of the degree of influence of equipment performance. This step corresponds to the operation unit 98 in FIG. 11. In this step, a calculation is made taking into account the heat rate deviation, i.e. the degree of influence of the equipments on the change of the heat rate.

The equipment checking step 171 makes the steps 161, 163 taken repeatedly for successive plant equipments.

The third path includes a corrected value printing step 155 in which the correction value corresponding to the change of operation state, for converting the actually measured heat rate to the heat rate of design basis, is printed.

It is possible to known from this correction value the state of operation of the plant. Thus, this value can be used as an index of the actual operation of the plant.

The deviations calculated in the steps 162, 163 are stored in the memory area successively in the order of load level and periods, in the step 165 for memorizing the calculation results. This step 165 corresponds to the memory 105 in FIG. 11. Simultaneously with the storage of the calculations results, the latter are printed out or displayed in the step 166 for printing out the calculation results.

As mentioned before, the diagnosis function 121 has another function, i.e. the detection of abnormality.

The mean value calculated in the step 161 is compared, in the equipment performance deviation calculation step 164, with the mean value of the degrees of influence of equipment performances obtained in the past. The result of the calculation is delivered to the equipment performance checking step 167 which corresponds to the comparator 101 and the judging device 102 in FIG. 11. In this step, the calculation result is compared with the Bogie value which is set for each equipment. The abnormality message printing step 168 is taken only when the Bogie value is exceeded to produce a message to inform the operator of the fact that the check or inspection of the equipment is necessary. This step 168 corresponds to the output device 103 in FIG. 11.

This process is taken for each equipment of the plant in the equipment checking step 171.

Figure 19:
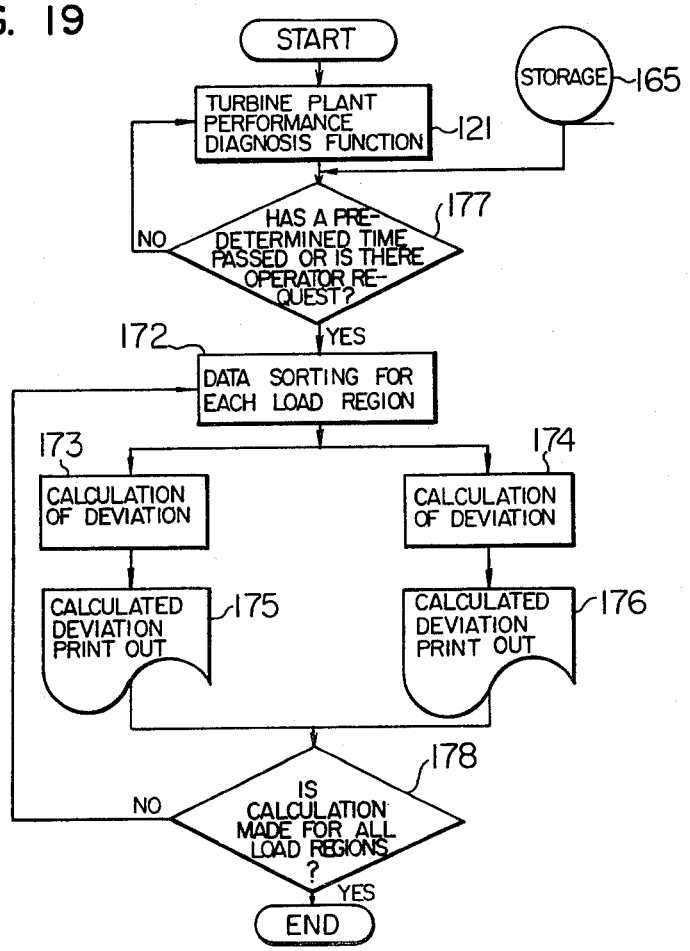
FIG. 19 is a detailed flow chart of the performance analysis process shown in FIG. 16.
Figure 18:
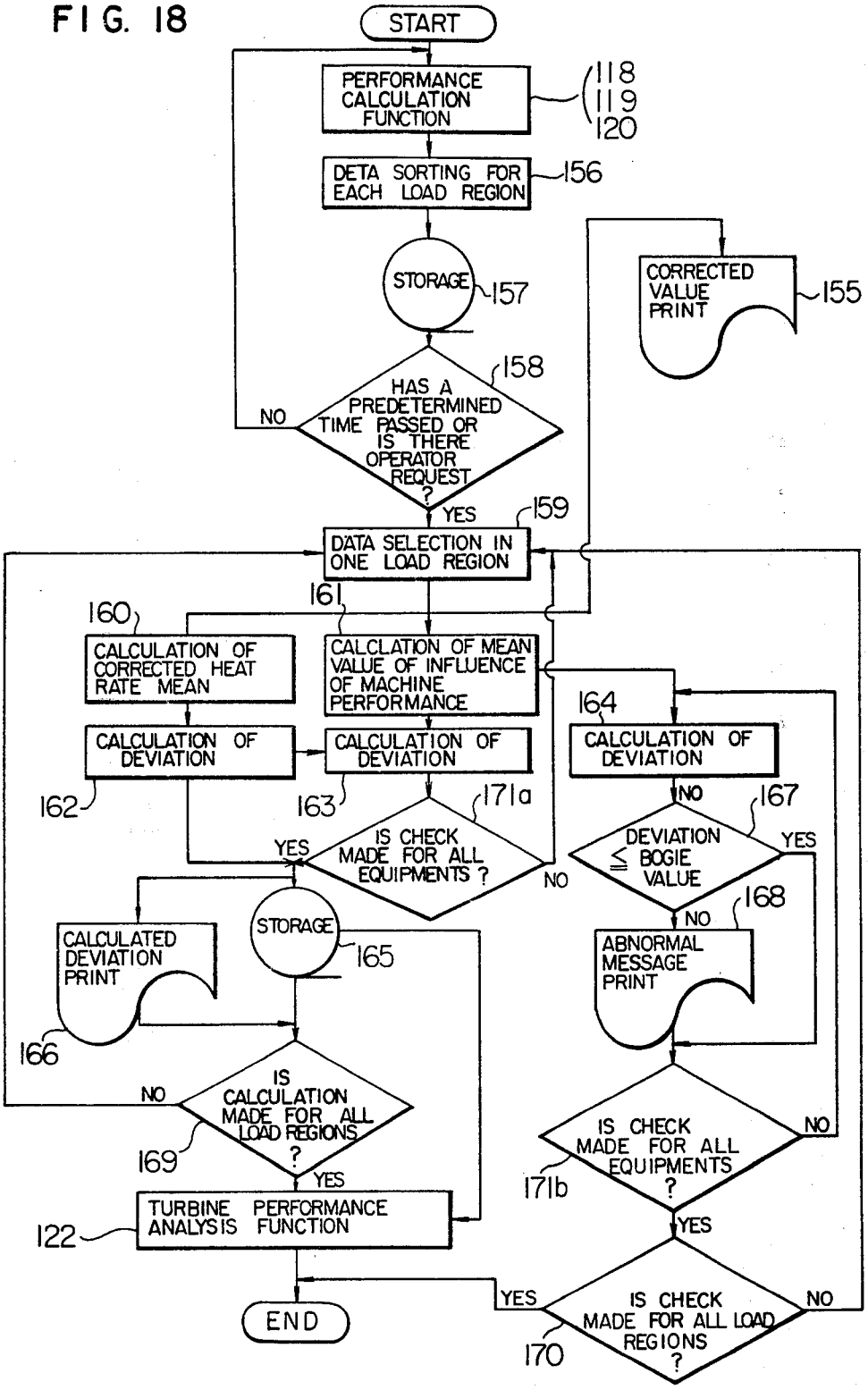
FIG. 18 is a detailed flow chart of the performance diagnosis process as shown in FIG. 16.

The steps after the step 159 are taken for all load regions. Thereafter, the process proceeds to the plant performance analysis function 122, the flow chart of which is shown in FIG. 19.

In the analysis start time checking step 177, the data stored in the memory area are delivered to the data sorting step 172, after elapse of a predetermined time length or in accordance with the operator request. The sorted data are delivered to the step 173 for calculating degradation of plant performance and the step 174 for calculating the degradation of performance of equipment, in the order of the data and year of memorization, for each load region. The step 173 corresponds to the operation unit 107 shown in FIG. 13, while the step 174 corresponds to the operation unit 110 in FIG. 13. These data are then processed in relation to the data obtained at the beginning period of operation of the plant or immediately after a periodical inspection. The results of these calculations are delivered to displaying steps 175 and 176 and are printed for each period and each load region. The displaying steps 175, 176 correspond to output devices 109, 113 shown in FIG. 13.

It is, therefore, possible to know the degradation of performance after the commencement of the operation of the plant, or after the latest periodical inspection.

In the plant performance diagnosis function 121 and the analysis function 122, it is possible to know the secular change of plant performance, by comparing the calculated heat rate deviation on the design basis with the past data (secular data) stored in the memory area. The information concerning the secular change is given only for the desired load region, upon request of the operator.

It is also possible to monitor the tendency of secular change of the equipments in the plant, by comparing the degree $\Delta HR$ of influence of the equipment performance on the turbine heat rate with the data obtained and stored in the past. By so doing, it is possible to grasp the secular change of the performance of equipment.

Namely, by grasping the tendency of secular change of the equipments in the plant, which tendency being obtained through comparison with the data obtained and stored in the past, it is possible not only to grasp the present state of operation of the plant but also to pre-estimate the future state of the equipments. This in turn permits an appointment of items to be repaired or modified in the next periodical inspection or when the plant is stopped for other reason. It will be seen that such a repair or modification will permit the plant to operate at a higher efficiency.

As will be understood from the foregoing description, it will be seen that, according to the invention, it is possible to obtain highly accurate and reliable calculation results, in view of the provision of the function for making judgement that the data for calculating and monitoring the performance are valid only when these data are obtained in the period in which the load fluctuation rate is within a predetermined level and this state of load fluctuation is maintained for a predetermined time length, and the function which makes a judgement that the values representing the state of operation are valid for the observation of performance when the deviation of the value representing the operation state falls below a predetermined level. It is, therefore, possible to provide diagnosis and analysis functions highly effective for the monitoring of the performance of a steam power generating plant.

The diagnosis and analysis functions permit, through comparison of the detected data with the data which have been obtained and stored in the past, the secular change of performance of the plant.

In addition, by determining the tendency of the secular change in the performance of equipment such as turbines, boilers, condensers, heaters, pumps and so forth, through comparison with the data obtained in the past with the degree of influence of performance of the equipment on the turbine heat rate, it is possible to monitor the present state of operation of the plant, as well as future secular change in performance of each equipment.

As has been described, according to the invention, it becomes possible to calculate the performance of the plant accurately, through discrimination of the steady and unsteady states of load imposed on the plant. In addition, the calculation of performance of the plant is made through a check of credibility of the detected values representing the operation state of the plant. Finally, it becomes possible to monitor and pre-estimate the secular change of the performance of the steam power generating plant.

What is claimed is:

1. A method of monitoring the performance of a steam power plant through calculation of performance comprising: detecting data including feedwater flow rate, steam pressure, steam temperature and load level which are representative of the states of operation of various parts of the plant, monitoring the fluctuation of said load level to detect the duration of any steady states of the load level, determining when the rate of fluctuation of the load level falls below a predetermined value to a steady state for at least a predetermined time length, whereby said data are judged to be valid and calculating the performance of said power plant as a function of the valid data by calculating at least one heat rate function.

2. A method of monitoring performance of a steam power plant in accordance with claim 1, wherein the calculation of at least one heat rate function includes calculating, when the rate of fluctuation of load level falls below said predetermined value for at least said predetermined time length, the enthalpy of the steam from said steam pressure and said steam temperature, calculating the flow rate of steam from said feedwater flow rate and said enthalpy, and calculating the heat rate of said steam power plant from said feedwater flow rate, steam flow rate, enthalpy and said load level, thereby to permit the monitoring of performance of said steam power plant.

3. A method of monitoring the performance of a steam power plant as recited in claim 1, comprising storing the calculated values of performance periodically at a constant time interval; and comparing the present calculated value of the performance with the periodically stored performance values, thereby to permit a diagnosis of performance of said steam power plant.

4. A method of monitoring the performance of a steam power plant through calculation of performance comprising detecting data including the feedwater flow rate, steam pressure, steam temperature and load level which represent the states of operation of various parts of said plant, monitoring the rate of fluctuation of said load level to detect when the rate of fluctuation of said load level falls below a predetermined level indicative of a steady state condition for at least a predetermined time length whereby said data are judged to be valid, checking the credibility of the detected valid data by a comparison of said detected data with corresponding reference values; and calculating the performance of said plant as a function of said detected valid data by calculating at least one heat rate function when said detecting devices are judged credible, thereby to permit the monitoring of performance of said steam power generating plant when said detected data are credible.

5. A method of monitoring the performance of a steam power plant as recited in claim 4, wherein said performance of said plant is calculated by a calculation of heat rate of said steam power plant from said detected valid data which are judged to be credible.

6. A method of monitoring the performance of a steam power plant as recited in claim 5, further comprising calculating the effect on the heat rate of equipments contained in said plant, thereby to permit the monitoring of performance of said plant.

7. A method of monitoring the performance of a steam power plant as recited in claim 6, wherein the heat rate of said steam power plant and the effect of each equipment on said heat rate of said plant are determined and then stored, thereby to permit the comparision of the present heat rate with the past heat rate.

8. A method of monitoring the performance of a steam power plant as recited in claim 5, comprising storing heat rates calculated periodically at constant time intervals, and comparing the stored heat rates with the present heat rate, thereby to permit a diagnosis of change of heat rate of said steam power generating plant.

9. An apparatus for monitoring the performance of a steam power plant of the type having detectors for detecting the feedwater flow rate, steam pressure, steam temperature and load imposed on said plant which represent the states of operation of various parts of said plant comprising plant performance calculating means for calculating said performance of said plant as a function of the data by calculating at least one heat rate function, said calculating means including a first comparator for comparing the rate of fluctuation of the load detected by said detector for detecting loads varying less than a predetermined reference value which is indicative of a steady state condition; a second comparator for comparing the time length within which the rate of fluctuation of the load is less than the reference value with a predetermined reference time length; and means for permitting said data to be delivered to said plant performance calculation means only when the rate of fluctuation of load falls below the predetermined reference fluctuation value for at least the predetermined reference value time length, in accordance with the outputs from said first and second comparators.

10. An apparatus for monitoring the performance of a steam power plant as recited in claim 9, further comprising means for storing the plant performance value calculated periodically at a constant time interval by said plant calculation means and means for comparing the plant performance values stored in said memory means with the presently calculated plant performance value thereby to permit the calculation of the change of said plant performance as a function of time.

11. An apparatus for monitoring the performance of a steam power plant having detectors for detecting feedwater flow rate, steam pressure, steam temperature and the load imposed on said plant which represent the states of operation of various parts of said plant comprising plant performance calculating means for calculating said performance of said plant as a function of the data by calculating at least one heat rate function from the detected data, data judging means for checking the credibility of said detectors by comparing said data detected by said detectors with respective reference values; a first comparator for comparing the rate of fluctuation of the load detected by said detector for detecting loads varying less than a predetermined reference value which is indicative of a steady state condition; a second comparator for comparing the time within which the rate of fluctuation of the load is less than the reference value; and means for permitting the detected data to be delivered through said data judging means to said plant performance calculation means from outputs of said first and second comparators only when the rate of fluctuation of said load falls below the predetermined reference fluctuation value for at least the predetermined time length.

12. An apparatus for monitoring the preformance of a steam power plant as recited in claim 11, further comprising means for storing said plant performance value calculated periodically at a constant time interval and means for comparing the plant performance value stored in said memory means with the presently calculated plant performance as a function of time.

* * * * *